US008148851B2

(12) United States Patent
Hahnlen et al.

(10) Patent No.: US 8,148,851 B2
(45) Date of Patent: Apr. 3, 2012

(54) SIMPLIFIED LIGHTING CONTROL SYSTEM

(75) Inventors: Brian D. Hahnlen, Plympton, MA (US); Jeremy W. Yon, Plympton, MA (US)

(73) Assignee: Litecontrol Corporation, Hanson, MA (US)

( * ) Notice: Subject to any disclaimer, the term of this patent is extended or adjusted under 35 U.S.C. 154(b) by 266 days.

(21) Appl. No.: 12/455,132

(22) Filed: May 27, 2009

(65) Prior Publication Data

US 2010/0301772 A1 Dec. 2, 2010

(51) Int. Cl.
*H01H 19/64* (2006.01)

(52) U.S. Cl. ..... 307/113; 307/114; 307/115; 307/157; 307/38

(58) Field of Classification Search ..... 307/113–115, 307/157, 38–40, 42
See application file for complete search history.

(56) References Cited

U.S. PATENT DOCUMENTS

| | | | | |
|---|---|---|---|---|
| 5,170,068 | A * | 12/1992 | Kwiatkowski et al. | 307/31 |
| 5,357,170 | A | 10/1994 | Luchaco et al. | |
| 7,215,088 | B1 | 5/2007 | Clark et al. | |
| 2008/0125873 | A1 | 5/2008 | Payne et al. | |

* cited by examiner

*Primary Examiner* — Rexford Barnie
*Assistant Examiner* — Toan Vu
(74) *Attorney, Agent, or Firm* — David W. Dranchak

(57) ABSTRACT

The invention offers an improvement in lighting control systems by providing a simplified power switching control system (i.e., using direct AC line voltage or DC current power switches instead of low voltage switches that control higher-current-capable relays) that controls the power to the power supplies that drive the light producing devices in a plurality of luminaires or lighting fixtures in a given installation. The lighting control system facilitates multiple modes of lighting configurations while requiring fewer switches that the prior art and also being easier to operate. The system supports the simultaneous use of multiple lighting technologies. Other embodiments showing extensions to the invention are also disclosed.

20 Claims, 14 Drawing Sheets

SIMPLIFIED LIGHTING CONTROL SYSTEM

FIELD OF THE INVENTION

The present invention relates to the control of lighting and more particularly, to the cost-effective control of a plurality of light sources for use in lighting fixtures/luminaires as well as standalone devices commonly used in lighting applications.

BACKGROUND OF THE INVENTION

The control of light and in particular artificial light is important for many reasons including ergonomic and ecological ones as well as energy and cost savings. Different approaches and control systems have been around for many years. A control system can be as simple as a single alternating current (AC) general purpose snap switch or as complex as centralized or decentralized overall energy management system. Complex integrated building management systems have their place by being able to offer advanced features such as internet and wireless access, utility interface for load shedding, messaging to issue maintenance alerts, and secure two-way communication to each device using a wide variety of communications methods such as low voltage control wiring, power line carrier communication, and any of a myriad of wireless connections.

While it may be desirable to have a complex system or even a sophisticated computer or controller-based lighting control system, many applications simply cannot justify, afford, or truly require such complexity either for the initial cost or for maintenance costs, especially when budgets are under increasing scrutiny. This leaves a wide gap for cost effective, simpler solutions.

It would be highly desirable to have a lighting control system that provides functionality that meets the basic needs of the occupants, while meeting all required safety codes and regulations, such as Underwriters Laboratories Inc. (UL) and the National Electrical Code (NEC), as well as industry standard requirements such as the Commission for High Performance Schools (CHPS) and the Leadership in Energy and Environmental Design (LEED) Green Building Rating System.

It is therefore an object of the invention to enhance the lighting control art.

It is another object of the invention to provide a lighting control system that needs no microprocessor control, requires no programming, or commissioning of devices.

It is yet another object of the invention to offer a lighting control solution that is easier to use, relatively simple to install, and can be implemented using inexpensive, readily available components.

SUMMARY OF THE INVENTION

The invention provides a means for the simplified power switching control (i.e., using direct AC line voltage or direct current (DC) power switches instead of low voltage switches that control higher-current-capable relays) of the power supplies that drive the light producing devices in an plurality of luminaires or lighting fixtures in a given installation. The lighting control system facilitates multiple modes of lighting configurations while requiring fewer switches than the prior art and also being easier to operate. The system supports the simultaneous use of multiple lighting technologies. Other embodiments showing extensions to the invention are also disclosed.

BRIEF DESCRIPTION OF THE DRAWINGS

A complete understanding of the present invention may be obtained by reference to the accompanying drawings, when taken in conjunction with the detailed description thereof and in which.

DETAILED DESCRIPTION OF THE PREFERRED EMBODIMENT

Figure 1:
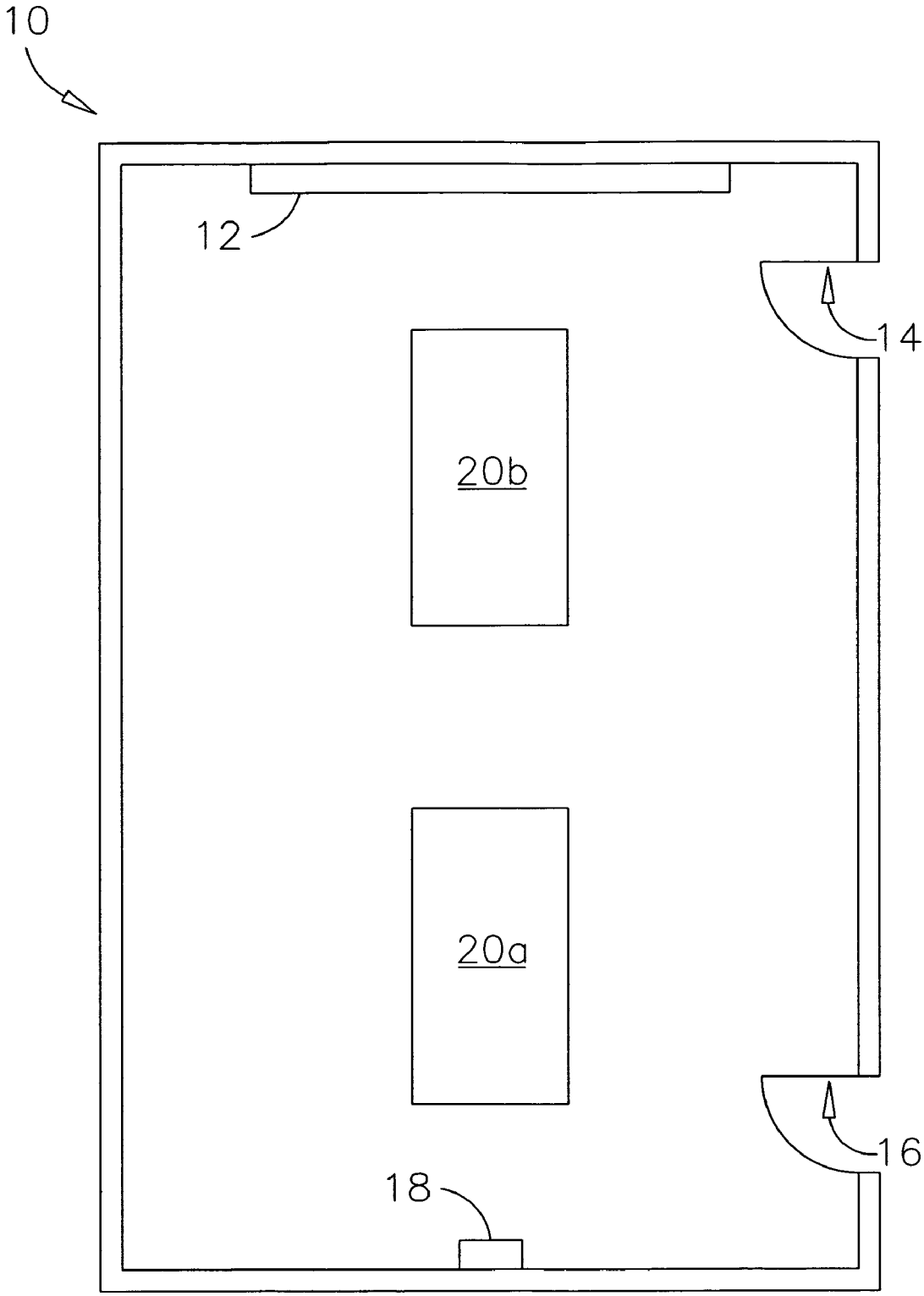
FIG. 1 is a plan view of a room including several typical elements in accordance with describing both the prior art examples and the embodiments of the present invention shown in FIGS. 3-7*c;*

Generally speaking, the present invention provides an improvement by simplification in lighting control technology by providing a means for the simplified power switching control (i.e., using direct AC line voltage or DC current switches instead of low voltage switches that control higher-current-capable relays) of the power supplies that drive the light producing devices in an plurality of luminaires or lighting fixtures. The lighting control system facilitates multiple modes of lighting configurations while requiring fewer switches than the prior art and also being easier to use. The essence of the invention lies in how the switches are wired together and to the loads, and not necessarily in the uniqueness of the individual components that comprise the control system.

It is beneficial to provide some definitions and drawings that include many of the elements and terms used in the descriptions of two prior art control systems, as well as in the various inventive embodiments disclosed hereinbelow to minimize redundancy.

The term "switch", which in one instance has been defined as a device for turning on or off, or directing an electric current, or for making or breaking a circuit. Switches are available in many different configurations and can be implemented in many different ways including a wide variety of manually-operated electrical switching devices that are commonly available, as well as in more sophisticated implementations including illuminated indicators and touch-sensitive panels, etc. that still offer a functionally similar device. While electrical switches do not have "sides" per se, in a schematic or wiring diagram, the input side and connection point(s) of a switch connected closer to the power source are commonly referred to as being on the "line" side of the switch. The output side and connection point(s) of a switch connected closer to what is being powered are commonly referred to as being on the "load" side of the switch. When an electrical switch is "open", it interrupts current from flowing through the switch, and when the switch is "closed", it allows current to flow to the remainder of the load connected to the switch.

The term "power switching device" is used to generally describe some of the various switching devices that are capable of proper operation in this invention. These devices include the switches described hereinabove as well as devices such as an occupancy sensor or a timer switch and any other electrical switching devices yet to be known or yet to be discovered. These devices may operate on alternating or on direct current, as long as they properly match the specific power source and required ratings for a given application. These devices have higher voltage and current ratings that differentiate them from "signal level" switches such as those commonly used to control relays.

Lighting fixtures, often referred to as luminaires, are commonly used for illumination due to their ease of installation and their flexibility to be able to be configured to simultaneously provide many different combinations of direct and indirect light in a wide variety of form factors and optional features. While luminaires are available in many different form factors, and may provide illumination through many different types of power supplies and corresponding light sources, one particular example will be used to help describe the prior art examples as well as the various embodiments of the invention, since the specific quantity of luminaires, and the quantity of and specific light generating means within the luminaires is not critical to the invention.

For the systems and embodiments for both the prior art examples and the invention described hereinbelow, the power source delivers alternating current, the light source in each luminaire is a plurality of linear fluorescent lamps, and the power supplies used to drive the lamps are AC-powered ballasts. It should be understood that the inventive control systems could just as easily be configured using a DC power source, light emitting diodes (LEDs) or strips of electroluminescent material for the light source, and a DC-input power supply to power the LEDs or strips of electroluminescent material. The inventive control system can be implemented using mixed lighting loads including incandescent lamps, self-ballasted lamps such as compact fluorescent or metal halogen lamps which may not even require a fixture, or any one of many other lighting components available to a person skilled in the art.

The term "electrically powered light producing device"as used herein is intended to generally describe some of the various devices that may comprise the lighting load that the inventive switching arrangements control. These devices include but are not limited to incandescent lamps, self-ballasted lamps such as compact fluorescent or metal halogen lamps, strips of electroluminescent material energized by a power supply, light emitting diodes powered by a power supply, and a wide variety of fluorescent ballasts energized by electronic or magnetic ballasts. The devices and power supplies/ballasts do not necessarily require a luminaire or lighting fixture, but they may certainly benefit by the inclusion of the same.

The term "switching arrangement" as used herein is intended to describe any combination of electrical switching devices and interconnections that are operatively connectable to a power source and to a load, for example, one or more electrically powered light producing devices to control the output of the light producing devices.

The specific AC voltage used in the various embodiments is not critical to the invention as long as the components are used within the limits for which they are intended. For example, it would be inappropriate to use a switch rated for 115 volts AC and 15 amperes of current for an application that draws 20 amperes of current and/or at an AC voltage of 277V. For DC applications, it is equally important that necessary calculations such as for ampacity are performed to ensure that a system is properly designed, reliable and safe. In any case, it is assumed that the components used in the disclosed embodiments meet all required safety codes and regulations.

It should be understood by those skilled in the art that a lighting control system may, and typically does have many more components, some optional, some necessary, than those components identified and described in this as well as additional embodiments hereinbelow. For clarity, some components such as junction boxes, back boxes (boxes used to house and/or facilitate wiring to devices such as switches and occupancy sensors), conduit, and other miscellaneous parts, which are commonly found in a real-world installed control system are intentionally excluded from many figures, along with other parts, such as brackets, screws and nuts, lamp sockets, some power and lamp wires, decorative parts, ground connections, etc. For example, it is common practice that the housing of a UL-approved AC switch is electrically connected to ground, but since switches are being represented schematically, the additional ground connections would make the line connections more difficult to see. This is done only to enlighten and not obfuscate the invention.

Referring first to FIG. 1, there is shown a plan view of a room 10, which is representative of a smaller conference room or classroom, and includes an audio visual (AV) screen 12 and two luminaires 20*a* and 20*b* with luminaire 20*b* located closer to screen 12. Room 10 also includes entrances or doors 14 and 16, and an occupancy sensor 18 that commonly requires an external power unit (not shown). All of the features and elements defined in room 10 are not necessarily used in each example or embodiment, but FIG. 1 contains the elements needed to help describe the control systems disclosed in the various inventive embodiments as well as the prior art examples. It should be understood by those skilled in the art that there may be more luminaires electrically connected in series or parallel to existing luminaires 20*a* and 20*b* to provide additional light for a larger room.

AV screen 12 may be implemented many different ways including as a passive projection screen, an active display (e.g., a liquid crystal display (LCD) or a plasma display), or a white board. It is desirable to be able to turn off the lights nearer to screen 12 so that the light from luminaire 20*b* does not distract from the information being displayed on screen 12. For this description, the lights in luminaire 20*b* are referred to as the "front lights" or "AV lights". In contrast, the lights in luminaire 20*a* are referred to as the "rear lights." This is a means to help define the need for more than one zone of light in a room. It should be understood that screen 12 is not necessarily a part of the inventive lighting control systems, but reference to it is also helpful in defining the need for having, controlling, and orienting more than one zone of light in a room.

Figure 2:
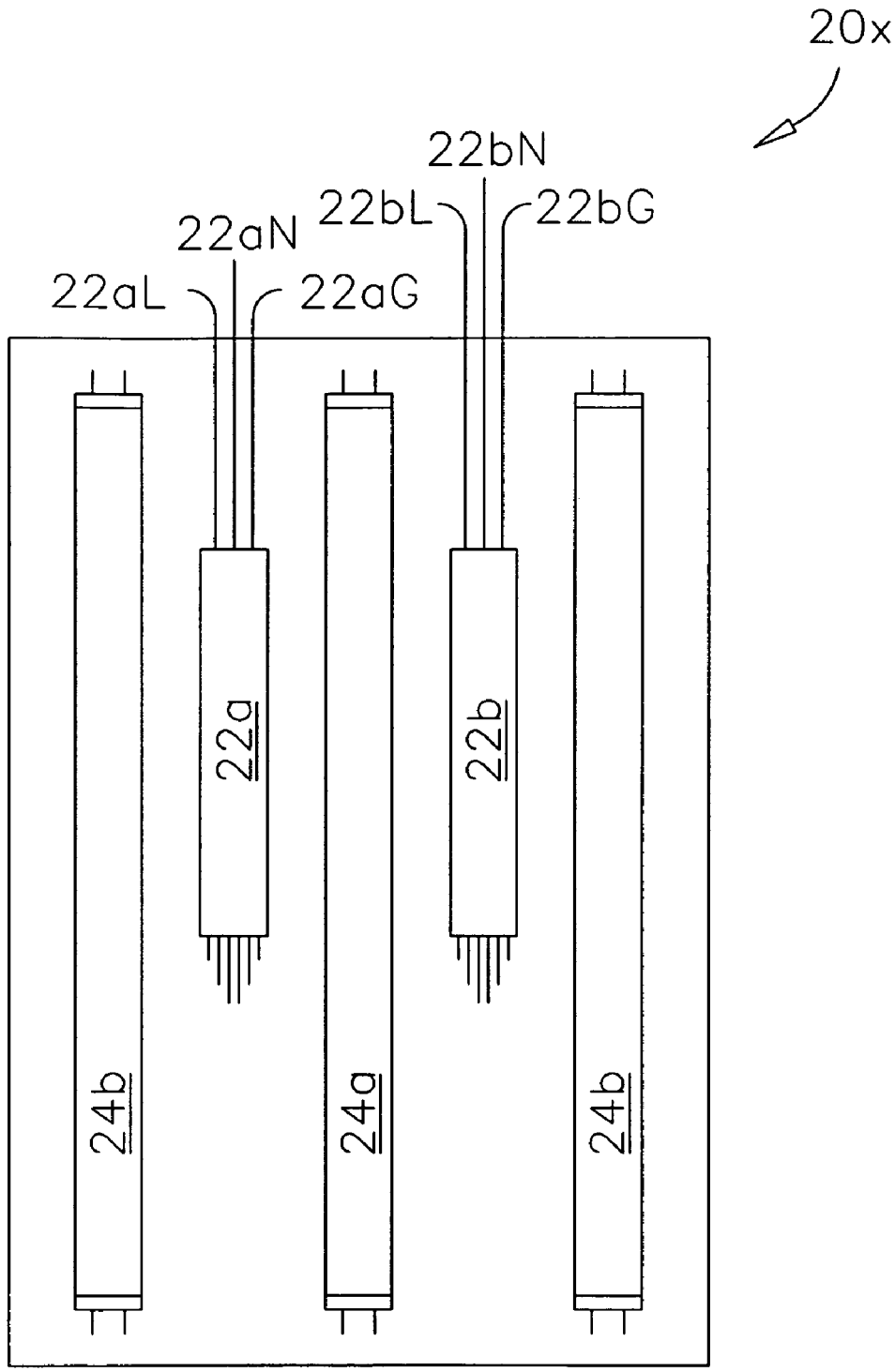
FIG. 2 is a section view of some of the components located in the luminaires shown in FIG. 1.

Referring now to FIG. 2, luminaires 20*a* and 20*b* each comprise a pair of power supplies implemented as AC powered ballasts 22*a* and 22*b*. The designation "20*x*" is used on FIG. 2 since the drawing represents both luminaires 20*a* and 20*b*. Ballasts 22*a* and 22*b* preferably are both of a rapid start configuration. While rapid start ballasts are preferred for prolonging fluorescent lamp life since they preheat the lamp filaments during lamp ignition, a characteristic especially desirable for applications with frequent switching. Instant start ballasts could also be used. Ballast 22*a* is used to power centered fluorescent lamp 24*a* and ballast 22*b* is used to power outer fluorescent lamps 24*b*. Lamps 24*a* and 24*b* are held in place and powered through lamp holders (not shown) which are mechanically connected to luminaires 20*a* and 20*b*. The wires to interconnect ballasts 22*a* and 22*b* to lamps 24*a* and 24*b*, respectively, are not shown for purposes of clarity and also since these interconnections are well known by those skilled in the art.

Ballasts 22*a* and 22*b* operate on AC line voltage (e.g., 120, 277 or 347 volts), with each having three power wires, line wire 22*a*L, neutral wire 22*a*N, and ground wire 22*a*G; and 22*b*L, neutral wire 22*b*N, and ground wire 22*b*G, respectively. If ballasts 22*a* and 22*b* each comprise a metal housing (not explicitly shown), ballasts 22*a* and 22*b* may derive their ground wire through the metal-to-metal contact of the housing to luminaire 20*a* or 20*b*. Metal luminaires 20*a* and 20*b* are typically required to be connected to ground by the various safety codes and regulations.

Furthermore, different models of ballasts 22*a* and 22*b* may and commonly do energize different quantities, types (e.g., T12, T8, T5 or T2 fluorescent lamps), lengths and wattages of lamps.

Figure 3:
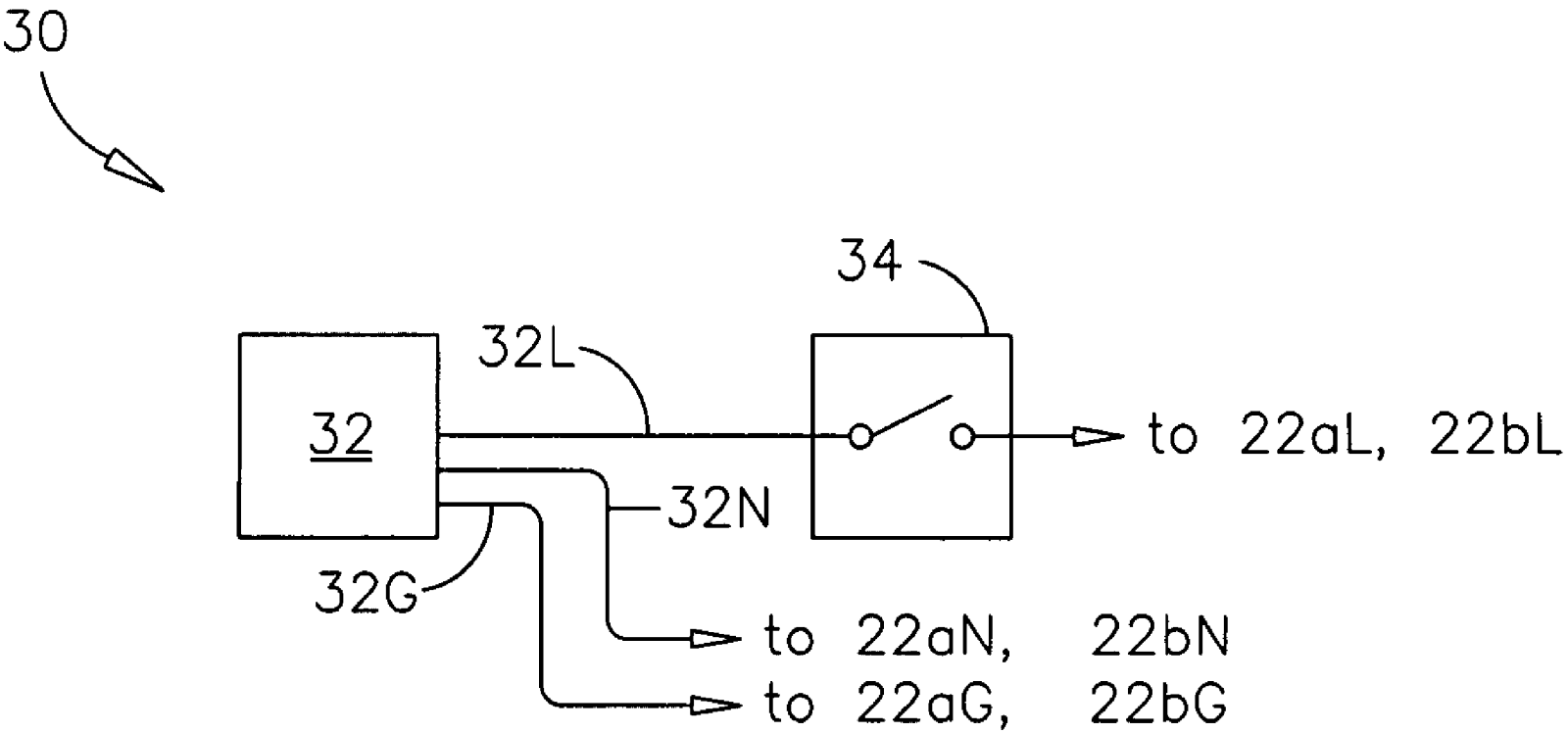
FIGURE 3 PRIOR ART
FIG. 3 is a schematic representation of a first lighting control system in accordance with the prior art.

Referring now to FIG. 1-3, there is shown possibly the simplest prior art control system for controlling the light output in a room. Lighting control system 30 includes a power source 32, a single pole, single throw (SPST) switch 34, and a pair of luminaires 20*a* and 20*b*. Power source 32 has three power connections, line 32L, neutral 32N, and ground 32G. Ground 32G is connected to earth ground. The power connections to luminaires 20*a* and 20*b* are connected in parallel, with ballast neutral wires 22*a*N and 22*b*N connecting to neutral 32N, and ballast ground wire 22*a*G and 22*b*G connecting to ground 32G. Line 32L of power source 32 connects to one side or connection point of SPST switch 34 while the other side or connection point connects to line 22*a*L and line 22*b*L, so that both luminaires 20*a* and 20*b* respond in a similar manner (i.e., both "on" at a particular light level, or both "off"). Switching of line 32L is shown for clarity, however switching of neutral 32N instead is also possible but not preferred.

Figure 4:
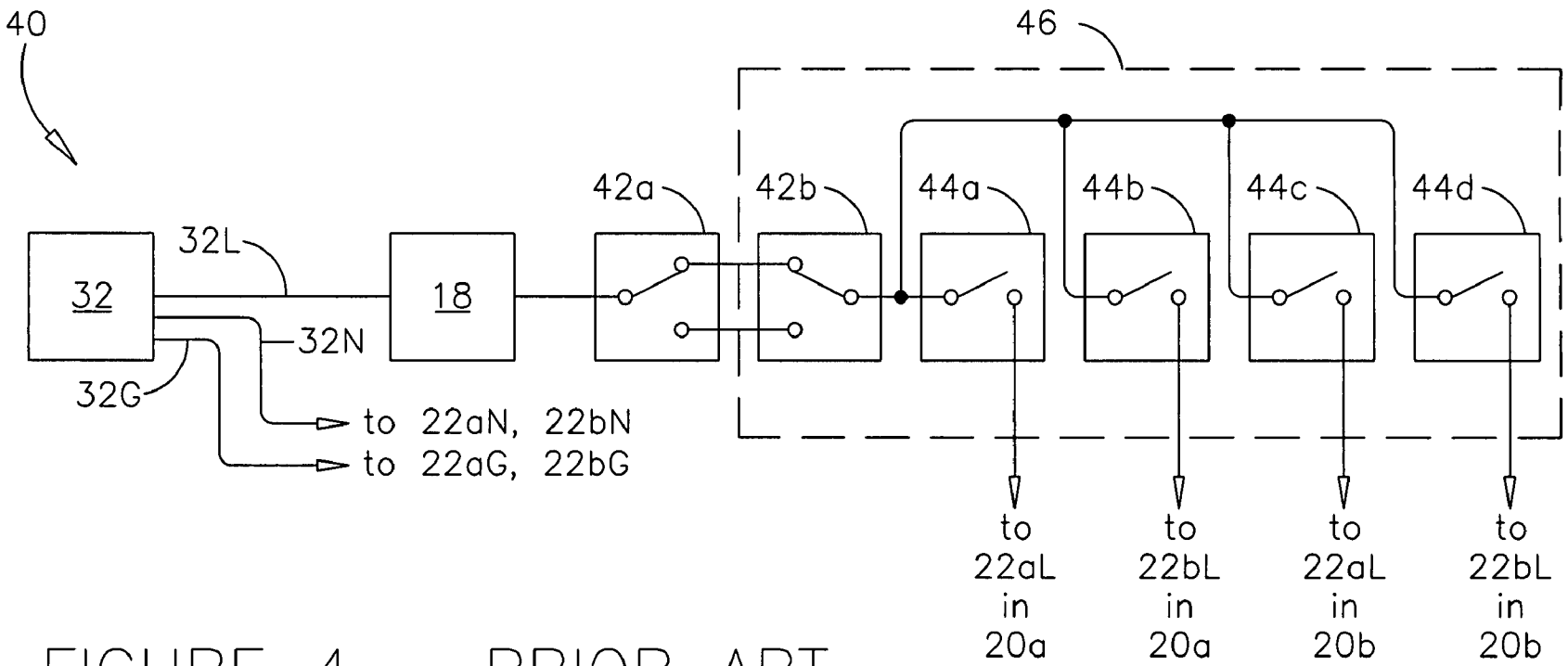
FIGURE 4 PRIOR ART
FIG. 4 is a schematic representation of a second lighting control system in accordance with the prior art.

Referring now to FIGS. 1, 2 and 4, there is shown a prior art system commonly used to control the lighting in a room. System 40 comprises an AC power source 32 with three conductors: line 32L, neutral 32N, and ground 32G; occupancy sensor 18; master on/off switches 42*a* and 42*b;* four SPST switches 44*a*, 44*b*, 44*c* and 44*d;* and luminaires 20*a* and 20*b*.

In control system 40, master on/off switch 42*a* is typically located near one entrance 16 of a room 10. Master on/off switch 42*b*, along with switches 44*a*-44*d*, is located in a five-switch control station 46 or switch grouping near a second entrance 14. Switches 42*a* and 42*b* are of a single pole, double throw (SPDT) configuration and are wired together in what is commonly referred to as a "three way switch" configuration, so that either switch 42*a* or 42*b* can be the master on/off switch at any point in time, unless system 40 had some other external means of controlling the power to luminaires 20*a* and 20*b*. Occupancy sensor 18 is commonly located electrically ahead of all switches such that the lighting can be turned off when the space is unoccupied regardless of any switch position.

Switch 44*a* allows ballast 22*a* and one fluorescent lamp 24*a* to provide the lower light level for luminaire 20*a*. Switch 44*b* allows ballast 22*b* and two fluorescent lamps 24*b* to provide the higher light level for luminaire 20*a*. Switch 44*c* allows ballast 22*a* and one fluorescent lamp 24*a* to provide the lower light level for luminaire 20*b*. Switch 44*d* allows ballast 22*b* and two fluorescent lamps 24*b* to provide the higher light level for luminaire 20*b*. If switches 44*a*-44*d* are all on, all of the lamps 24*a* and 24*b* in both luminaires 20*a* and 20*b* are illuminated.

While such a lighting control system 40 provides control over the lights within a room, it has been found that the plurality of switches is commonly more of a hindrance for the user and a higher-than-needed light level is often chosen. Also, when designers, engineers and architects are trying to meet stringent industry standards, they must take into account the possibility that all of the lamps in the application may be illuminated when performing lighting load calculations, thereby making meeting energy conservation codes and standards that much more difficult.

Therefore it would be beneficial to have a system that a) a person skilled in the art, such as an electrician equipped with the appropriate wiring diagrams, can readily implement using commonly available, off-the-shelf components, b) offers a simpler approach to lighting control switching, and c) makes it easier for lighting designers to meet the stringent industry standards.

Figure 5:
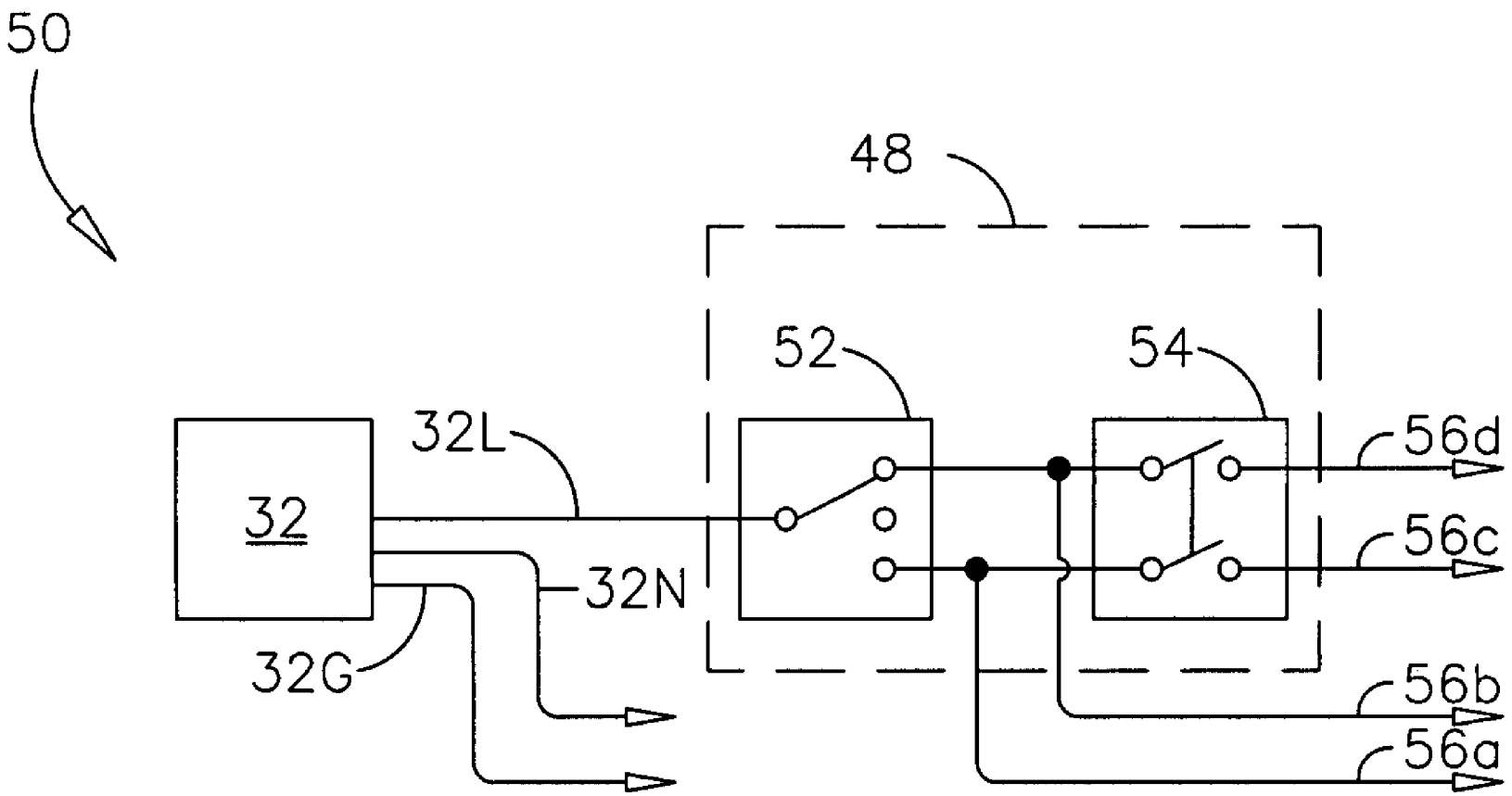
FIG. 5 is a schematic representation of a lighting control system in accordance with one embodiment of present invention.

Referring now to FIGS. 1, 2 and 5, all in accordance with a first embodiment of the present invention, there is shown a control system 50 used to control the lighting in a room 10. System 50 comprises an AC power source 32 having three connections: line 32L, neutral 32N, and ground 32G; switches 52 and 54; and luminaires 20*a* and 20*b*. Switches 52 and 54 are typically located in a two-switch control station 48 or switch grouping near either entrance 14 or 16 of room 10. Switch 52 is of a single pole, double throw, center off configuration and combines the functions of two switches by acting as both a master on/off and higher/lower light level switch, unless system 50 had some other external means (not shown) of controlling the power to luminaires 20*a* and 20*b*. Switch 52 can also be of a single pole, triple throw configuration, which would not require "off" being located in the center position, although this configuration is less common.

Ballasts 22*a* and 22*b* neutral wires 22*a*N and 22*b*N connect to power source neutral 32N, and ballast ground wires 22*a*G and 22*b*G connect to power source ground 32G. Line 32L of power source 32 connects to one side, contact or connection point of switch 52 while the other side is wired so that when switch 52 is set to a first position, it allows switched line 56*a* to provide power to ballasts 22*a* and fluorescent lamps 24*a* to provide the lower light level for luminaires 20*a* and 20*b;* when set to a second position it functions as "off" as with a master on/off switch; and when set to a third position it allows switched line 56*b* to provide power to ballasts 22*b* and fluorescent lamps 24*b* to provide the higher light level for luminaires 20*a* and 20*b*. Switch 54 is of a double pole, single throw (DPST) configuration. One side of switch 54 electrically connects to both switched line 56*a* and switched line 56*b* (i.e., the first and third positions of switch 52), and allows or impedes current from flowing through switched line 56*c* to ballasts 22*a* in luminaire 20*b*, and through switched line 56*d* to ballast 22*b* also in luminaire 20*b*. Since luminaire 20*b* is closer to AV screen 12, this allows information displayed on screen 12 to be more easily viewed when switch 54, which may also be referred to as the "AV on/off" or "front on/off" switch, is in the "off" position.

While this embodiment demonstrates the minimum number of switches needed to implement the invention, that being two, it also has limitations compare to the other embodiments disclosed hereinbelow. Those limitations/drawbacks are because the configuration of switch 52 precludes adding one additional SPDT switch to allow switch 52 and the additional switch to be used and act as a "three way switch" to allow a second master on/off switch near another entrance. Also a single pole, double throw, center off switch is less readily available and typically much more expensive that a standard SPDT switch.

Figure 6:
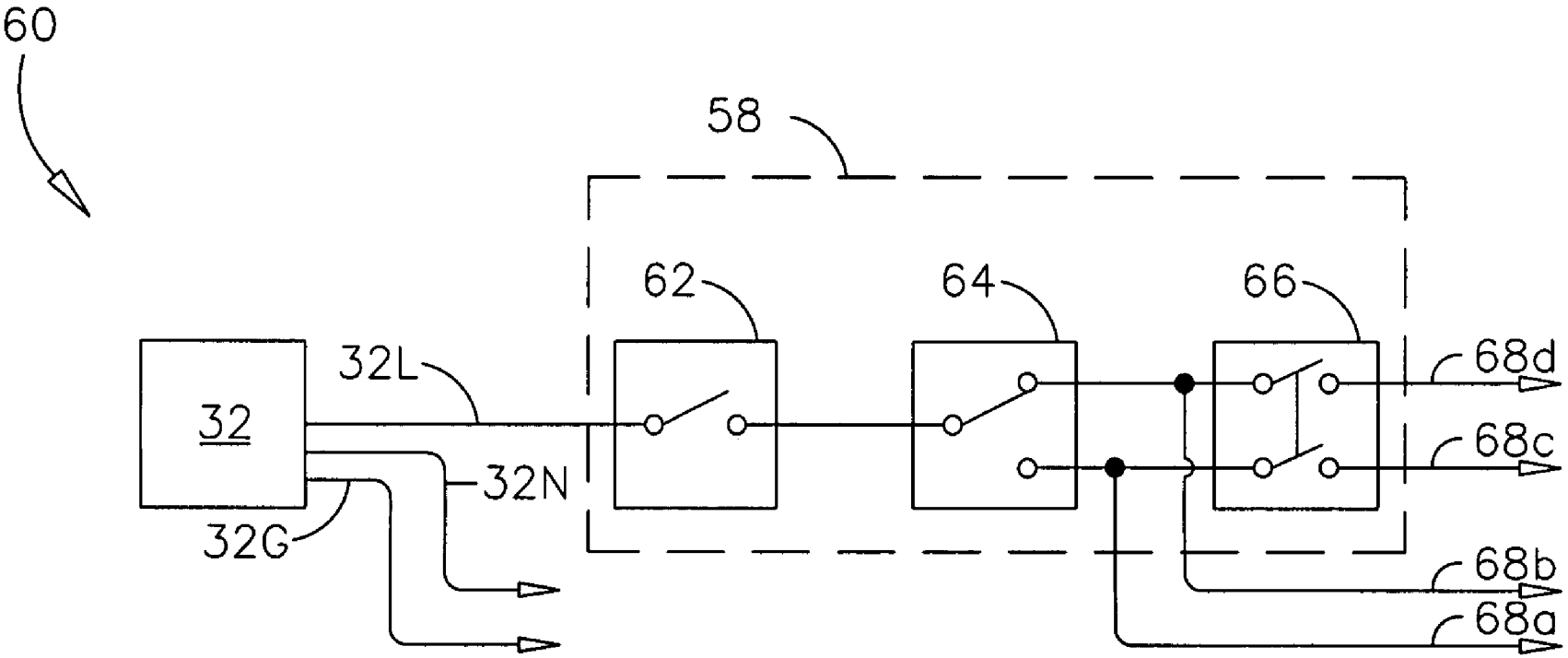
FIG. 6 is a schematic representation of a lighting control system in accordance with a second embodiment of present invention.

Referring now to FIGS. 1, 2 and 6, all in accordance with a second embodiment of the present invention, there is shown a lighting control system 60 used to control the lighting in a room. System 60 comprises an AC power source 32 having three connections: line 32L, neutral 32N and ground 32G, switches 62, 64 and 66; and luminaires 20*a* and 20*b*. Master on/off switch 62 and higher/lower light level switch 64 and switch 66 are typically located in a three-switch control station 58 or switch grouping near either entrance 14 or 16 of room 10. Switch 62 acts as the master on/off unless system 60 had some other external means (not shown) of controlling the power to luminaires 20*a* and 20*b*. Switch 62 is of a SPST configuration, switch 64 is of a SPDT configuration, and switch 66 is of a DPST configuration. The prior art approach, as shown in FIG. 4, requires at least two additional switches to accomplish the same tasks.

Ballasts 22*a* and 22*b* neutral wires 22*a*N and 22*b*N connect to power source neutral 32N, and ballast ground wires 22*a*G and 22*b*G connect to power source ground 32G. Line 32L of power source 32 connects to one side of master on/off switch 62 while the other side is wired to a first side of higher/lower light level switch 64. When switch 64 is set to the "lower" setting, it allows switched line 68*a* to power ballasts 22*a* and fluorescent lamps 24*a* to provide the lower light level for luminaires 20*a* and 20*b;* in the "higher" setting it allows switched line 68*b* to power ballasts 20*b* and fluorescent lamps 24*b* to provide the higher light level for luminaires 20*a* and 20*b*. One side of DPST switch 66 electrically connects to both switched lines 68*a* and 68*b* (the lower and higher positions of switch 64, respectively), and allows or impedes current from flowing through switched line 68*c* to ballasts 22*a* in luminaire 20*b*, and through switched line 68*d* to ballast 22*b* also in luminaire 20*b*. Since luminaire 20*b* is closer to AV screen 12, this allows information displayed on screen 12 to be more easily viewed when switch 66, which may also be referred to as the "AV on/off" or "front on/off" switch, is in the "off" position.

There is one limitation with this embodiment. The use of a SPST configuration for switch 62 keeps costs lower, but it precludes adding one additional SPDT switch as a second master on/off switch near another entrance, thus allowing switch 62 and the additional switch the flexibility to be wired together and act as a "three way switch."

Figure 7A:
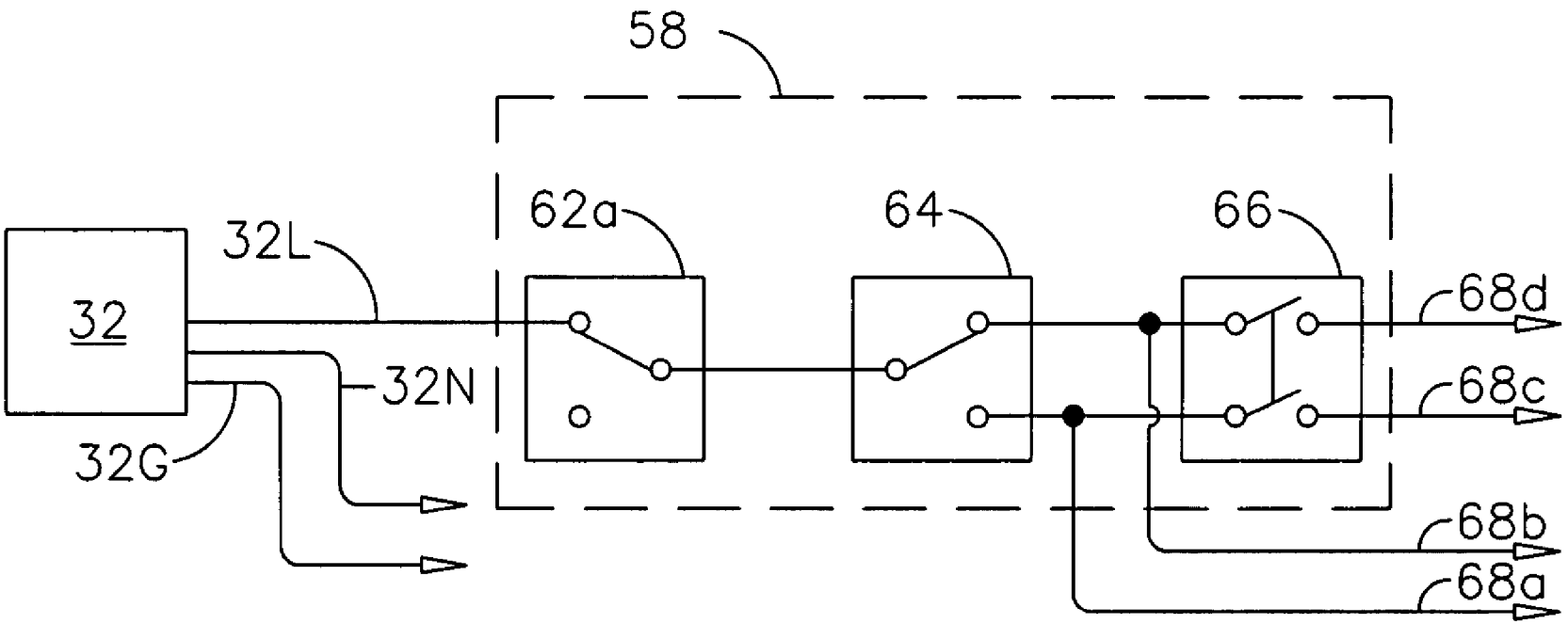
FIGS. 7*a*-7*c* are schematic representations of optional improvements to the lighting control system shown in FIG. 6.
Figure 7B:
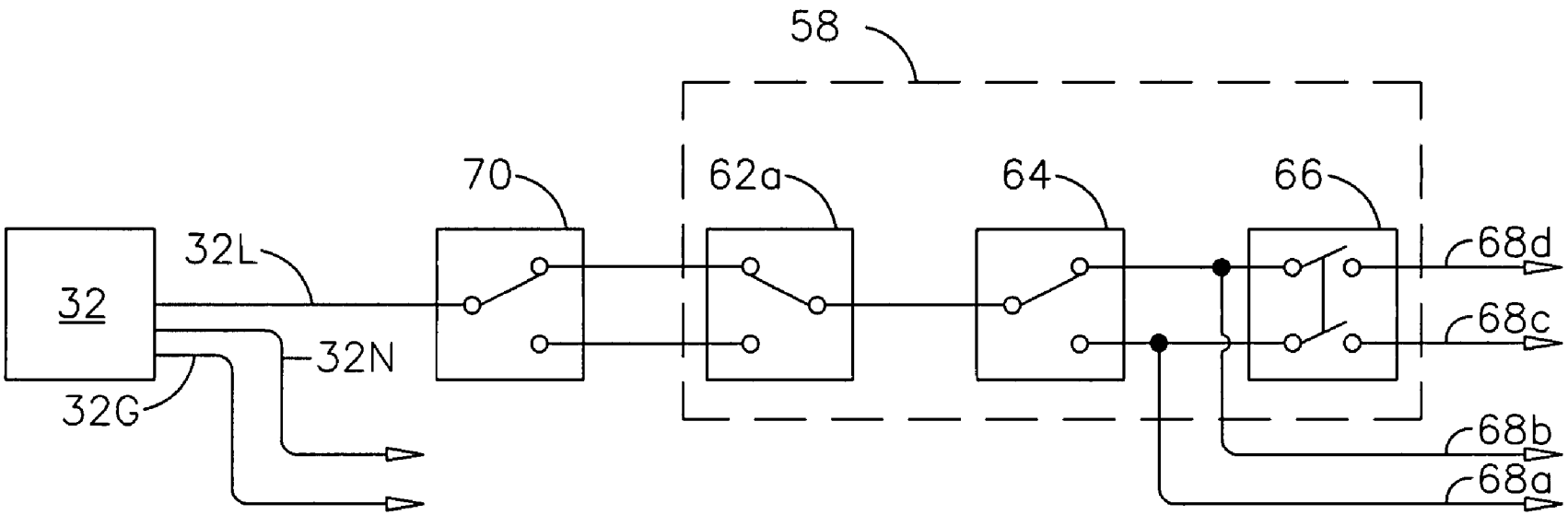
Figure 7C:
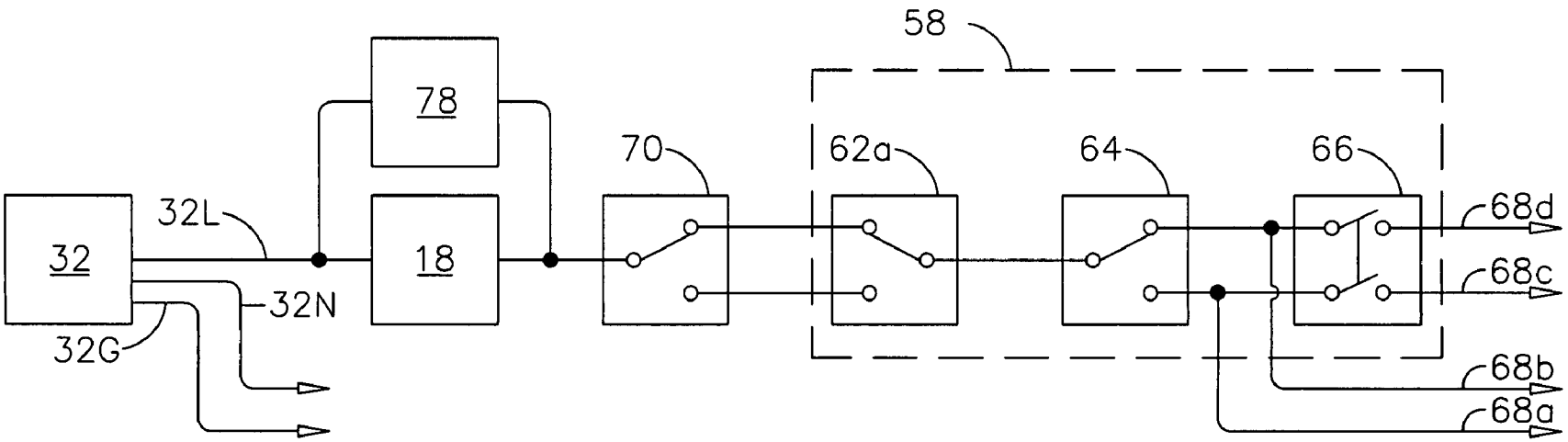

Referring now to FIGS. 7*a*-7*c*, there are shown three improvements to the embodiment disclosed in FIG. 6. It is important to note that these improvements would enhance the system functionality, but they require no change to the remaining portion of the embodiment.

Referring now to FIGS. 6 and 7*a*, system 60 can be enhanced by replacing SPST master on/off switch 62 with a SPDT switch 62*a*. This allows system. 60, with simply the addition of an additional SPDT switch and a slight rewiring to be upgraded to the benefits of a "three way switch" described hereinabove (i.e., two master on/off switches).

Referring now to FIGS. 6 and 7*b*, system 60 can be enhanced by replacing SPST master on/off switch 62 with a SPDT switch 62*a* and adding an additional SPDT switch 70 electrically connected to switch 62*a* in a "three way switch" configuration described hereinabove with the capability of having a pair of master on/off switches. In this enhanced version of control system 60, master on/off switch 70 is typically located near one entrance 16 of room 10, while master on/off switch 62*a*, along with switches 64 and 66, are located in a three-switch control station 58 or switch grouping near a second entrance 14. The prior art approach, as shown in FIG. 4, requires at least two additional switches to accomplish the same tasks.

Referring now to FIGS. 6 and 7*c*, system 60 can be further enhanced over the improvement in FIG. 7*b* by adding an occupancy sensor 18 and/or a timer switch 78 that could bypass the function of occupancy sensor 18. They are located in parallel between power source 32 and switch 64. Timer switch 78 is useful if an occupant wants to make certain that an "off" signal generated by occupancy sensor 18 does not turn the lights off for a period of time as specified by the timer. For certain applications, it may be desirable to use timer switch 78 instead of occupancy sensor 18, or to use occupancy sensor 18 and/or timer switch 78 in place of or in addition to a power switching device.

There are some applications that lend themselves to a modification of the inventive control system disclosed hereinabove. An example of this is for the case when luminaires comprise two power supplies or ballasts, and where each power supply/ballast drives an equal number of lamps or lighting devices. In this instance, the wiring of the "lower/higher" switch as defined in the embodiments disclosed hereinabove would not be useful since the two positions would yield approximately equal light output. This can be easily overcome by modifications to the switch configuration and the connection of the switched lines.

Figure 8:
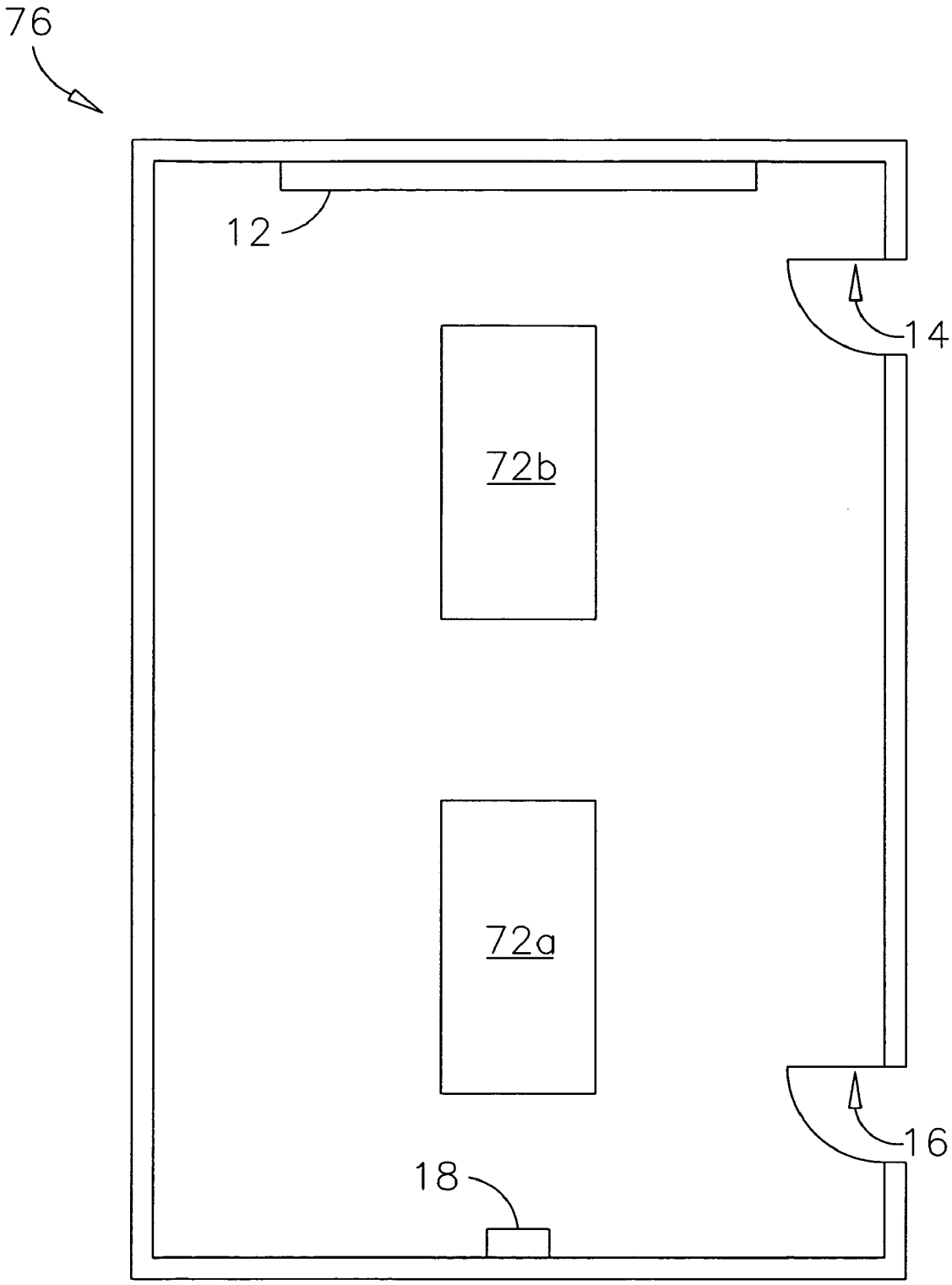
FIG. 8 is a plan view of a room including several typical elements in accordance with another embodiment of the present invention.
Figure 9:
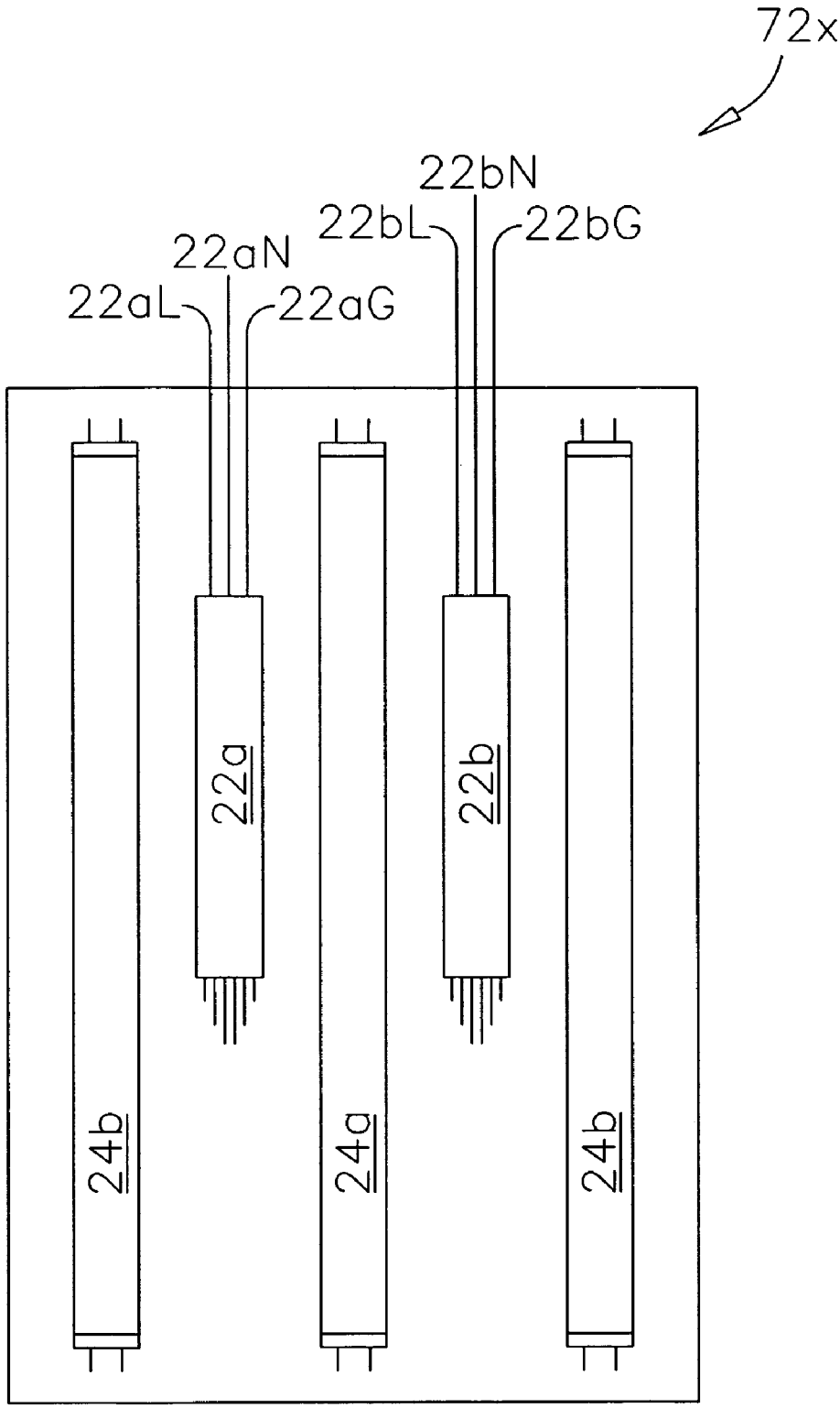
FIG. 9 is a section view of some of the components located in the luminaires shown in FIG. 8.
Figure 10:
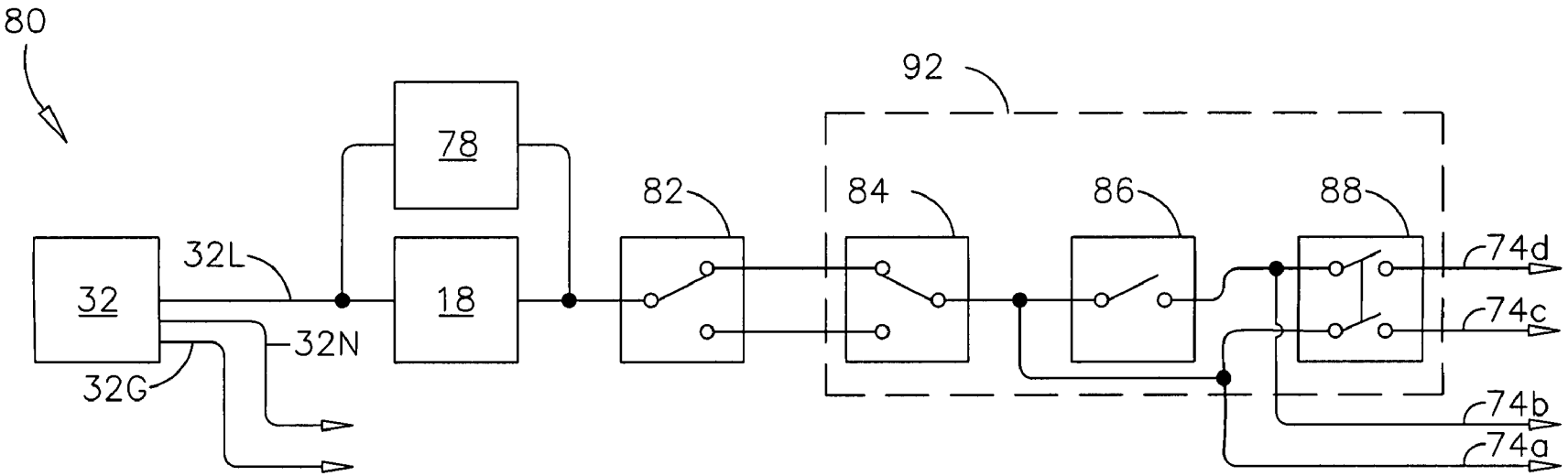
FIG. 10 is a schematic representation of a lighting control system in accordance with an embodiment of present invention that includes FIGS. 8 and 9.

Referring now to FIGS. 8-10, there is shown another embodiment with similar but slightly different wiring of the switches compared to previously disclosed embodiments. FIG. 8 shows a room 76 with entrances 14 and 16, occupancy sensor 18, and a pair of luminaires 72*a* and 72*b*. FIG. 9 shows luminaires 72*a* and 72*b* defined very much like luminaires 20*a* and 20*b* shown in FIG. 2 except that ballasts 22*a* and 22*b* only power a single lamp in each luminaire 72*a* and 72*b*. The designation "72*x*" is used on FIG. 9 since the drawing represents both luminaire 72*a* and luminaire 72*b*. Ballast 22*a* powers fluorescent lamp 24*a* and ballast 22*b* powers only a single fluorescent lamp 24*b*. Lamps 24*a* and 24*b* are held in place and powered through lamp holders (not shown) which are mechanically connected to luminaires 72*a* and 72*b*. Again the wires to interconnect ballasts 22*a* and 22*b* to lamps 24*a* and 24*b*, respectively, are not shown for purposes of clarity and also since these interconnections are well known by those skilled in the art. The power connections to ballasts 22*a* and 22*b* are unchanged.

Control system 80 is used to control the lighting in a room 76. System 80 comprises an AC power source 32 having three connections: line 32L, neutral 32N, and ground 32G; switches 82, 84, 86 and 88; occupancy sensor 18, timer switch 78 and luminaires 72*a* and 72*b*. Master on/off switch 82 is typically located near a first entrance 16 of room 76. Master on/off switch 84, higher/lower light level switch 86 and front AV on/off switch 88 are typically located in a three-switch control station 92 or switch grouping near entrance 14 of room 76. Switches 82 and 84 are electrically connected in a "three way switch" described hereinabove with the capability of having a pair of master on/off switches unless system 80 had some other external means of controlling the power to luminaires 72*a* and 72*b*. Switches 82 and 84 are of a SPDT configuration, switch 86 is of a SPST configuration, and switch 88 is of a DPST configuration. Again, the prior art approach, as shown in FIG. 4, requires at least two additional switches to accomplish the same tasks.

Ballasts 22*a* and 22*b* neutral wires 22*a*N and 22*b*N connect to power source neutral 32N, and ballast ground wires 22*a*G and 22*b*G connect to power source ground 32G. Line 32L of power source 32 connects to one side of the parallel combination of occupancy sensor 18 and timer switch 78. The other side of occupancy sensor 18 and timer switch 78 connects to one side of master on/off switch 82 while each connection point of the other side of switch 82 connects to a corresponding pair of connection points on master on/off switch 84 as typical in a "three way switch" configuration. The other side of switch 84 is connected to a first side of SPST higher/lower light level switch 86 and to switched line 74*a* to power ballasts 22*a* and fluorescent lamps 24*a* to provide the lower light level for luminaires 72*a* and 72*b*. When switch 86 is moved to the "higher" setting or position, it allows switched line 74*b* to power ballasts 22*b* and fluorescent lamps 24*b* to provide the higher light level for luminaires 72*a* and 72*b*. One side of DPST switch 88 electrically connects to both switched lines 74*a* and 74*b*, respectively, and allows or impedes current from flowing through switched line 74*c* to ballasts 22*a* in luminaire 72*b*, and through switched line 74*d* to ballast 22*b* also in luminaire 72*b*. Since luminaire 72*b* is closer to AV screen 12, this again allows information displayed on screen 12 to be more easily viewed when switch 88, which may also be referred to as the "AV on/off" or "front on/off" switch, is in the "off" position.

Therefore in contrast to the previous disclosed embodiments, higher/lower light level switch 86 switches ballasts 22*b* on or off, but has no effect on ballasts 22*a*. In spite of the differences in switch configurations and wiring, the switches of system 80 appear to maintain the same functionality to the end user as did the systems in system 60 with the enhancements shown in FIG. 7*c*. It should also be understood that in this embodiment, since the light generated by powering ballast 22*a* is approximately the same as the light generated by powering ballast 22*b*, it is moot as to which ballasts 22*a* or 22*b* are chosen to generate the lower light level and which one is chosen to generate the higher light level.

Figure 11:
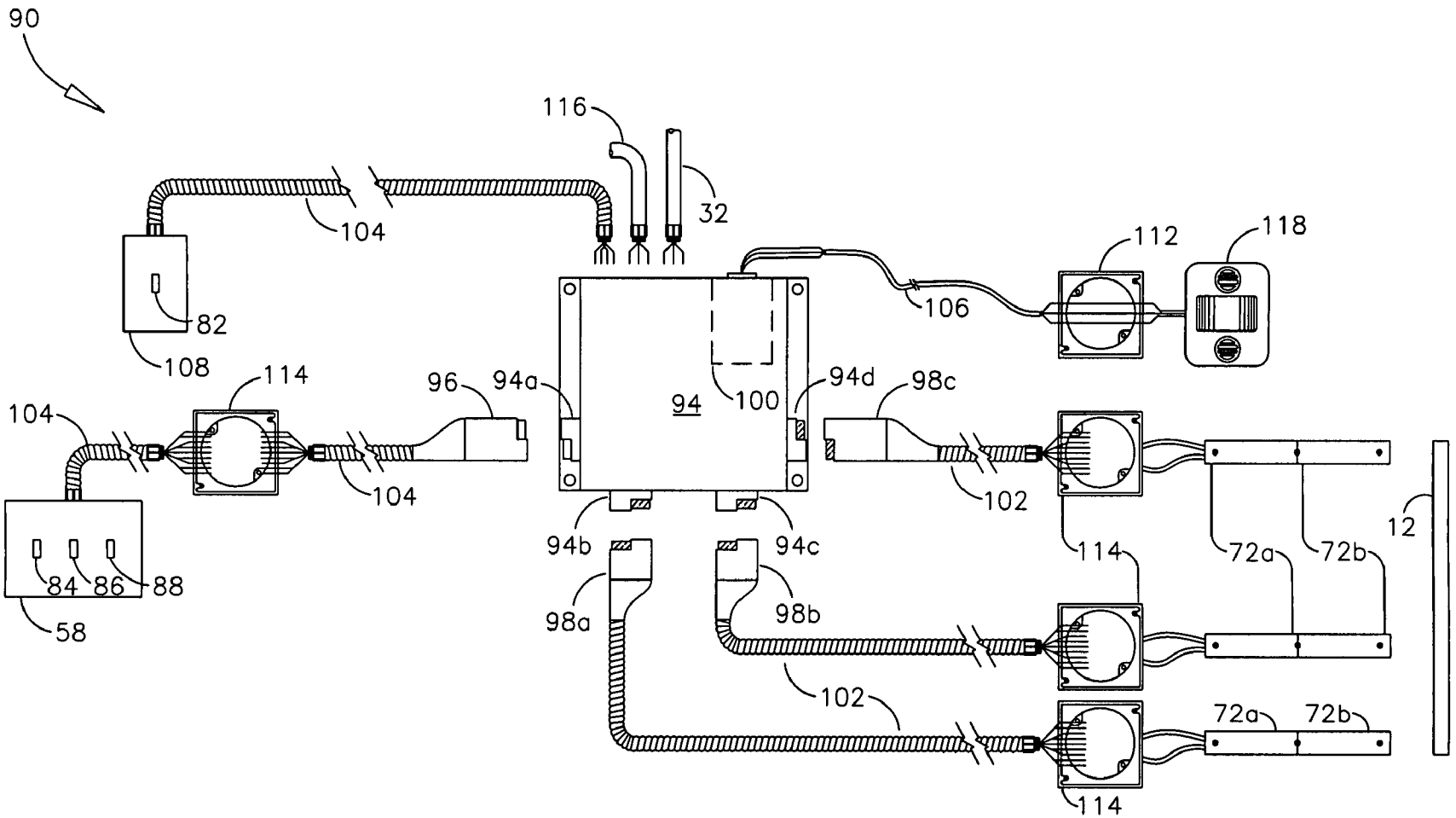
FIG. 11 is an exploded view of a lighting control system including optional components that enhance the installation of the system.

Referring now to FIG. 11, there is shown a lighting control system 90 that is based on lighting control system 80 (FIGS. 8-10), but includes some additional components found in some real world applications as well as components that make installation easier.

System 90 comprises an AC power source 32 having three connections: line 32L, neutral 32N, and ground 32G; switch 82 located in a single-switch control station 108; switches 84, 86 and 88 located in three-switch control station 58; occupancy sensor 18 and a plurality of luminaires 72*a* and 72*b*. These components function equivalently as in system 80 (FIGS. 8-10). The components that comprise luminaires 72*a* and 72*b* remain the same even though they are not explicitly shown in FIG. 11.

Many of the additional components shown in FIG. 11 make installation of system 90 much easier. The heart of this installation modularity is a control splice box (CSB) 94 that accepts a plurality of modular wiring connectors 96 and 98*a*-98*c*, and provides a pre-wired platform to facilitate ease of in-field connections. The connectors 94*a*-94*d* on CSB 94 and their mating connectors 96 and 98*a*-98*c*, respectively, are preferably polarized and color coded to differentiate voltage rating, current rating, etc. and to eliminate any chance of incorrect or improper wiring. The main enclosure of CSB 94 is made from cold-rolled steel, although other materials may also be used. In any case, it is important that all of the components used in system 90 meet all required safety codes and regulations. Connections to CSB 94 made by wires or cables such as power source 32 are made through knockout openings (not shown) in CSB 94.

System 90 also includes a plurality of junction boxes 114 and back boxes 112. Junction boxes 114 are containers for electrical junctions, usually intended to be concealed from sight and to reduce the chances of tampering. The containers of junction boxes 114 are commonly made from metal or plastic. Back boxes 112 are similar to junction boxes 114 except that they typically are designed with a solid surface area with pre-drilled and tapped-hole configurations to mount the majority of industry appliances/devices. Both boxes 112 and 114 typically include ground wire connection points (not shown) and an array of knockout openings (not shown) to accept various MC cables 102 and 104, as well as electrical metal tubing (EMT) (not shown). CSB 94 also includes provision for an occupancy sensor cable 106 that is used to connect occupancy sensor power supply 100 through back box 112 to occupancy sensor 18. Additional wires or cables such as feed through wiring cable 116 are also included to allow system 90 to be expandable.

In addition to the wires/conductors described in system 80 (FIGS. 8-10), system 90 includes additional conductors (not shown) such as an "unswitched line" conductor through the wire bundles within metal clad (MC) cables 102 to luminaires 72*a* and 72*b*, which can be used to power additional components. An "unswitched line" can be useful to monitor power regardless of the position of switches 82, 84, 86 and 88 as well as the state of occupancy sensor 18. An emergency battery ballast (not shown) could be connected to ballasts 22*a* and 22*b* and to the "unswitched line." Upon loss of power provided by power supply 32 as signaled by loss of the "unswitched line", the emergency battery would discharge and energize lamps 24*a* and 24*b*. The "unswitched line" is also useful to supply power to occupancy sensor power supply 100, which is located within CSB 94 in this embodiment, as well as to power additional automated controls (not shown) such as photocells to implement daylight harvesting. Wires in system 90 are preferably color coded to eliminate any chance of incorrect or improper wiring.

It should be understood by those skilled in the art that many other ways to modularize system 90 may also be implemented without departing from the spirit of the invention.

It should be understood that the switches used in the various embodiments of the inventive control systems include the minimal amount of "poles" and "throws" and positions needed to accomplish the task at hand, but switches with additional "poles" and "throws" and positions could be used in the disclosed embodiments for many different reasons such as availability, volume pricing, etc. Furthermore, it should be obvious that one skilled in the art could scale the disclosed embodiments to accommodate more complex applications without departing from the spirit of the invention.

The disclosed systems can be used with more than one type of power supply/light producing devices within a given system (e.g., ballasts and fluorescent lamps in addition to LED power supplies and LEDs). While the disclosed systems can be implemented using other light sources, the systems are not necessarily designed to be implemented with high intensity discharge (HID) lamps since HID lamps have typically not worked well in systems frequently turned on and off, whether by switch or occupancy sensor, due to the warm-up time required by HID lamps. Improvements in HID technology could change this and make limitations of this sort moot.

A variant or "hybrid" of the inventive control systems comprising dimming ballasts as the power supplies is disclosed hereinbelow. In this hybrid system, the switching for the master on/off switch(s) and the AV on/off switch could still be implemented by performing power switching control using ordinary AC switches. But the "lower/higher" function would be implemented differently because of the capabilities of the dimming ballasts.

A common interface to control the light level of a dimming ballast is the two wire, analog voltage, 0-10 volt dimming interface, which typically has a gray wire and a violet wire that are both electrically isolated from the input power connections as well as the lamp connections. For the embodiment disclosed hereinbelow, you could electrically common the two dimming wires from the ballast in each luminaire together (violet to violet and gray to gray), so that the light level of the two ballasts may be controlled together. A SPDT "lower/higher light level" switch in the control system could be used to switch in a fixed or variable resistor between the two 0-10 volt wires in either one or both switch positions to alter the voltage between the two control lines and therefore change the light level. In a ballast with a 0-10 volt interface, when the two dimming wires are not connected (i.e., an open circuit), the light level is at the maximum level. If the two wires are connected together (i.e., a short circuit or approximately zero ohms of resistance), the ballast lowers the light level to its minimum level. The lower/higher light level switch could even be replaced by a switch with even more positions (and corresponding resistors) or by a 0-10 volt dimmer for even more flexibility in setting the light level.

Figure 12:
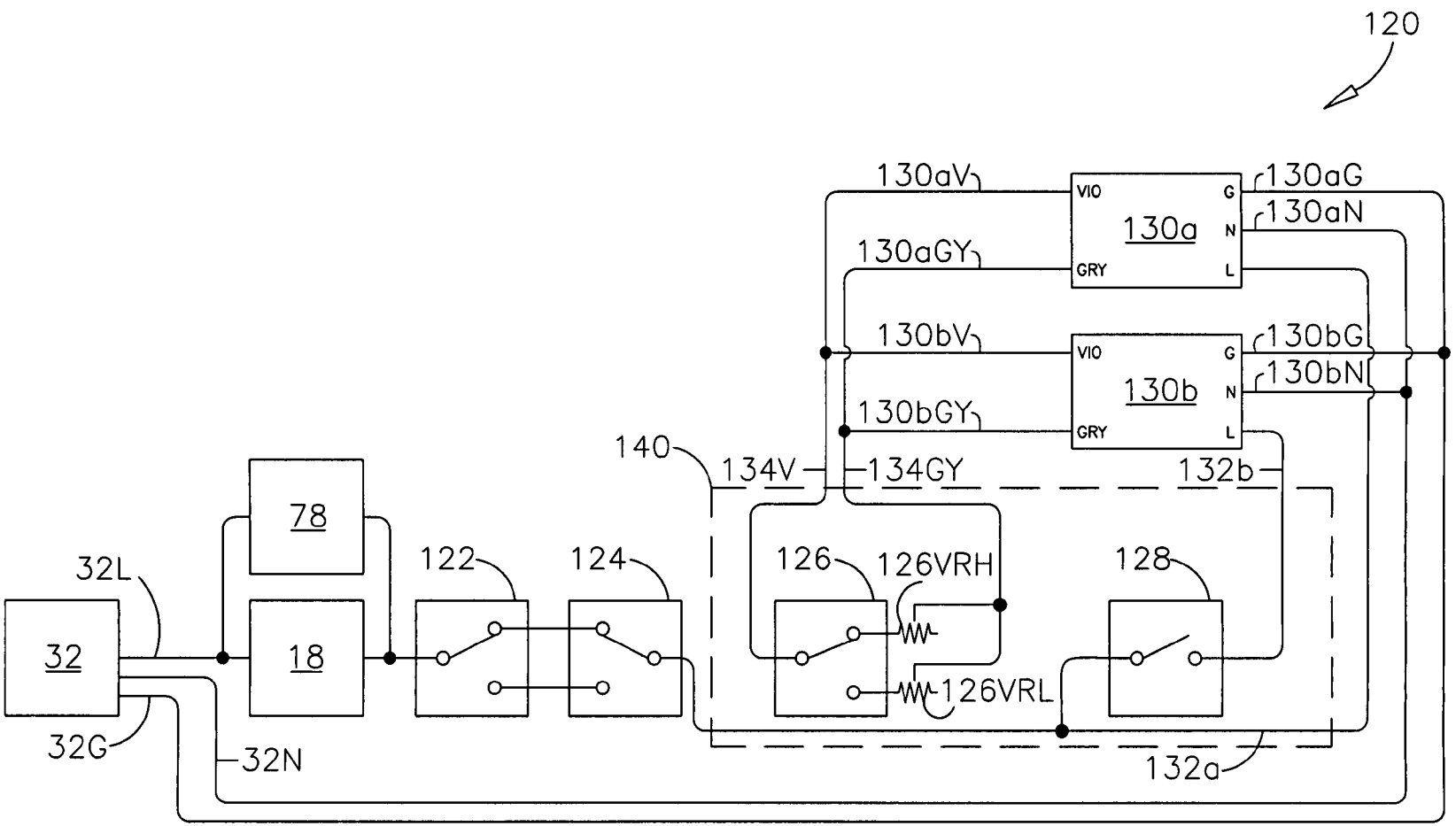
FIG. 12 is a schematic representation of a lighting control system in accordance with an embodiment of present invention that demonstrates the invention with dimmable power supplies.

Referring now to FIG. 12, there is shown another embodiment that comprises dimmable power supplies/ballasts. Lighting control system 120 is used to control the lighting in a room (not shown). System 120 comprises an AC power source 32 having three connections: line 32L, neutral 32N, and ground 32G; switches 122, 124, 126 and 128; occupancy sensor 18, timer switch 78 and ballasts 130*a* and 130*b*. Since a dimming fluorescent lamp ballast typically has a rapid start configuration, the fluorescent lamps connect to ballasts 130*a* and 130*b* either the same or similarly to rapid start non-dimming ballasts 22*a* and 22*b* (FIGS. 2 and 9). Therefore no further discussion of the dimming ballast/lamp interface is deemed necessary, and the emphasis will be placed on showing the inventive switching arrangement and the power and dimming interconnection to dimming ballasts 130*a* and 130*b*. Lamps, luminaires and other components disclosed in the previous embodiments are not shown but are still considered part of an overall system.

Master on/off switch 122 is typically located near a first entrance (not shown) of a room. Master on/off switch 124, higher/lower light level switch 126 and front AV on/off switch 128 are typically located in a three-switch control station 140 near a second entrance (not shown) of the room. Switches 122 and 124 are electrically connected in a "three way switch" described hereinabove with the capability of having a pair of master on/off switches unless system 120 had some other external means of controlling the power to ballasts 130*a* and 130*b*. Switches 122, 124 and 126 are of a SPDT configuration, and switch 128 is of a SPST configuration.

Ballasts 130*a* and 130*b* neutral wires 130*a*N and 130*b*N connect to power source neutral 32N, and ballast ground wires 130*a*G and 130*b*G connect to power source ground 32G. Line 32L of power source 32 connects to a connection point on one side of the parallel combination of occupancy sensor 18 and timer switch 78. The connection point on the other side of occupancy sensor 18 and timer switch 78 connects to the connection point on one side of master on/off switch 122 while each connection point on the other side of switch 122 connects to a corresponding pair of connection points on master on/off switch 124 as typical in a "three way switch" configuration. The connection point on the other side of switch 124 is connected to a connection point on the first side of AV switch 128 and to switched line 132*a* to power ballast 130*a* and fluorescent lamp(s) (not shown). The connection point on the other side of AV switch 128 is connected to switched line 132*b* to power ballast 130*b* and fluorescent lamp(s) (not shown). Since ballast 130*b* is again used to power light generating devices in a luminaire (not shown) located closer to AV screen (not shown), this again allows information displayed on the screen to be more easily viewed when switch 128, which may also be referred to as the "AV on/off" or "front on/off" switch, is in the "off" position.

Although the disclosed embodiments only show a single occupancy sensor 18, it will be recognized that additional sensors (not shown) may be included and operatively connected, for example, in parallel with existing occupancy sensor 18. Such additional sensors may also be used to replace or augment the functionality of other switches (e.g., other SPST switches) within the disclosed switching arrangements.

One connection point of SPDT "lower/higher" switch 126 is attached to the violet wire 134V, which then connects to 130*a*V on ballast 130*a* and 130*b*V on ballast 130*b*. The connection point on the lower position on the opposite side of switch 126 connects through a variable resistor 126VRL, while the connection point on the upper position connects through a variable resistor 126VRH. The connection points on the other side of variable resistors 126VRL and 126VRH both connect to gray wire 134GY which then connects to 130*a*GY on ballast 130*a* and 130*b*GY on ballast 130*b*. Therefore variable resistors 126VRL and 126VRH can be used to independently set both the upper and lower light levels of system 120. It should be understood that, depending on the specifications of ballasts 130*a* and 130*b*, variable resistor 126VRH may not be needed (this would offer no dimming at the "high" setting). Also variable resistors 126VRL and/or 126VRH could be replaced by fixed resistors without departing from the spirit of the invention. Variable resistors 126VRL and 126VRH are shown in FIG. 12 as being external to "lower/higher" switch 126, but they can be located within and connected internally to switch 126 if so desired.

One benefit of this type of system is that you may potentially need only a single power supply/ballast instead of the pair of power supplies/ballasts in each luminaire as shown in the non-dimming disclosed embodiments, which may likely reduce overall ballast power consumption since there would be only half of fixed losses from the ballasts. Another benefit of the 0-10 volt dimming interface is that a 0-10 volt-based daylight harvesting sensor could easily be connected to the same pair of violet and gray wires to provide additional energy conservation.

When using this approach it is important to ensure that the grouping of switches would meet all of the required electrical and safety codes since you now have line voltage wiring and switches, and the 0-10 volt control wires (typically Class 1 or Class 2 wiring) potentially in the same junction box.

The embodiments disclosed hereinabove were shown with power supplies/ballasts and light producing devices within each luminaire that drew approximately the same amount of power and produced approximately the same amount of light luminaire-to-luminaire when illuminated. It should be understood that different wattage power supplies/ballasts, light producing devices and dimming interfaces could be used within a particular application to accomplish application-specific requirements and still be within the spirit of the invention.

Since other modifications and changes varied to fit particular operating requirements and environments will be apparent to those skilled in the art, this invention is not considered limited to the representative examples chosen for purposes of this disclosure, and covers all changes and modifications which do not constitute departures from the true spirit and scope of this invention.

Having thus described the invention, what is desired to be protected by Letters Patent is presented in the subsequently appended claims.

What is claimed is:

1. A switching arrangement to control the flow of electrical current through a plurality of switched lines to a plurality of electrically powered light producing devices (EPLPDs) comprising:

a) a first power switching device (PSD) comprising at least one pole, a first connection point on a line side of said first PSD and at least a first, a second and a third connection point on a load side of said first PSD, and having a first, a second, and a third position; said first connection point on said line side operatively connectable to a power source; said first connection point on said load side of said first PSD being electrically connected to a first switched line operatively connectable to a first group consisting of at least one EPLPD selected from said plurality of EPLPDs to generate a first light output when said first PSD is in said first position; said second connection point on said load side of said first PSD being electrically connected to a second switched line operatively connectable to a second group consisting of at least one other EPLPD selected from said plurality of EPLPDs to generate a second light output when said first PSD is in said second position; said first PSD adapted to selectively interrupt current from flowing to said plurality of EPLPDs when said first PSD is in said third position; and b) a second PSD comprising at least a first and a second pole, each having a respective first and second connection point, said first connection point on a line side of said first pole being electrically connected to said first switched line, and said first connection point on said line side of said second pole being electrically connected to said second switched line, said first connection point on a load side of said first pole being electrically connected to a third switched line, said third switched line operatively connectable to a subset of said first group of said plurality of EPLPDs; and said second connection point on said load side of said second pole being electrically connected to a fourth switched line, said fourth switched line operatively connectable to a subset of said second group of said plurality of EPLPDs;

wherein said first PSD is adapted to selectively interrupt current flowing from said power source to said plurality of EPLPDs and adapted to selectively allow current to flow to either said first or said second group of said plurality of EPLPDs depending on which of said first and second positions of said first PSD is selected; and said second PSD is adapted to selectively interrupt current from flowing to said subsets of said first and second groups of said plurality of EPLPDs.

2. The switching arrangement as recited in claim 1, wherein at least said first PSD comprises at least one chosen from the group: an electrical switch; an occupancy sensor; and a timer switch.

3. A switching arrangement to control the flow of electrical current through a plurality of switched lines to a plurality of electrically powered light producing devices (EPLPDs) comprising:

a) a first power switching device (PSD) comprising at least one pole and first and second connection points, said first connection point operatively connectable to a power source;

b) a second PSD comprising at least one pole, a first connection point on a line side of said second PSD, at least a first and a second connection point on a load side of said second PSD, and having a first and second position; said first connection point on said line side being electrically connected to said second connection point of said first PSD; said first connection point on said load side of said second PSD being electrically connected to a first switched line operatively connectable to a first group consisting of at least one EPLPD selected from said plurality of EPLPDs to generate a first light output when said second PSD is in said first position; said second connection point on said load side of said second PSD being electrically connected to a second switched line operatively connectable to a second group consisting of at least one other EPLPD selected from said plurality of EPLPDs to generate a second light output when said second PSD is in said second position; and c) a third PSD comprising at least a first and a second pole, each having a respective first and second connection point, said first connection point on a line side of said first pole being electrically connected to said first switched line, and said first connection point on said line side of said second pole being electrically connected to said second switched line, said first connection point on a load side of said first pole being electrically connected to a third switched line, said third switched line operatively connectable to a subset of said first group of said plurality of EPLPDs; and said second connection point on said load side of said second pole being electrically connected to a fourth switched line, said fourth switched line operatively connectable to a subset of said second group of said plurality of EPLPDs;

wherein said first PSD is adapted to selectively interrupt current flowing from said power source to said plurality of EPLPDs, said second PSD is adapted to selectively allow current to flow to either said first or said second group of said plurality of EPLPDs depending on which of said first and said second positions of said second PSD is selected; and said third PSD is adapted to selectively interrupt current from flowing to said subsets of said first and second groups of said plurality of EPLPDs.

4. The switching arrangement as recited in claim 3, wherein at least said first PSD comprises at least one chosen from the group: an electrical switch; two electrical switches, each comprising at least one pole, two positions and three connection points, said two electrical switches being electrically connected in a "three way switch"configuration; an occupancy sensor; and a timer switch.

5. A switching arrangement to control the flow of electrical current through a plurality of switched lines to a plurality of electrically powered light producing devices (EPLPDs) comprising:

a) a first power switching device (PSD) movable between an open and a closed position comprising at least one pole and first and second connection points, said first connection point operatively connectable to a power source, said second connection point being electrically connected to a first switched line operatively connectable to a first group consisting of at least one EPLPD selected from said plurality of EPLPDs to generate a first quantity of light when said first PSD is in said closed position;

b) a second PSD movable between an open and a closed position comprising at least one pole and a first and a second connection point, said first connection point being electrically connected to said second connection point of said first PSD and to a first switched line operatively connectable to a first group of said plurality of EPLPDs to generate a first light output, said second connection point being electrically connected to a second switched line operatively connected to a second group of said plurality of EPLPDs to generate a second light output; and c) a third PSD comprising at least a first and a second pole, each having a respective first and second connection point, said first connection point on a line side of said first pole being electrically connected to said first switched line, and said first connection point on said line side of said second pole being electrically connected to said second switched line, said first connection point on a load side of said first pole being electrically connected to a third switched line, said third switched line operatively connectable to a subset of said first group of said plurality of EPLPDs; and said second connection point on said load side of said second pole being electrically connected to a fourth switched line, said fourth switched line operatively connectable to a subset of said second group of said plurality of EPLPDs;

wherein said first PSD is adapted to selectively interrupt current flowing from said power source to said plurality of EPLPDs, said second PSD is adapted to selectively allow current to flow to said second group of said plurality of EPLPDs depending on which of said open and said closed positions of said second PSD is selected; and said third PSD is adapted to selectively interrupt current from flowing to said subsets of said first and second groups of said plurality of EPLPDs.

6. The switching arrangement as recited in claim 5, wherein at least said first PSD comprises at least one chosen from the group: an electrical switch; two electrical switches, each comprising at least one pole, two positions and three connection points, said two electrical switches being electrically connected in a "three way switch" configuration; an occupancy sensor; and a timer switch.

7. A switching arrangement to control the flow of electrical current to a plurality of electrically powered light producing devices (EPLPDs) comprising:

a) a first power switching device (PSD) operatively connectable to a power source, said first PSD adapted to selectively interrupt current from flowing to said plurality of EPLPDs;

b) a second PSD having at least a first and a second position, said second PSD movable between said first and second positions, said second PSD being electrically connected to said first PSD and operatively connectable to a first group consisting of at least one EPLPD selected from said plurality of EPLPDs to generate a first light output when said second PSD is in said first position, and operatively connectable to one chosen from the group: a second group consisting of at least one other EPLPD selected from said plurality of EPLPDs to generate a second light output, and both said first and second groups, when said second PSD is in said second position, thereby allowing said plurality of EPLPDs to produce a different light output when said second PSD is moved between said first and second positions; and c) a third PSD having at least two poles, said third PSD being electrically connected to said second PSD and operatively connectable to subsets of said first and second groups of said EPLPDs, said third PSD selectively interrupting current to said subsets of said first and second groups of said EPLPDs to prevent said subsets of said first and second groups of said EPLPDs from generating a light output.

8. The switching arrangement as recited in claim 7, wherein at least said first PSD comprises at least one chosen from the group: an electrical switch; two electrical switches, each comprising at least one pole, two positions and three connection points, said two electrical switches being electrically connected in a "three way switch" configuration; an occupancy sensor; and a timer switch.

9. A switching arrangement to control the flow of electrical current to a plurality of switched lines comprising:

a) a first power switching device (PSD) comprising at least one pole, said first PSD operatively connectable to a power source, said first PSD adapted to selectively allow current to flow to a plurality of switched lines;

b) a second PSD comprising at least one pole and having at least a first and a second position, said second PSD being electrically connected to said first PSD and to a first of said plurality of switched lines when said second PSD is in said first position, and being electrically connected to one chosen from the group: a second switched line, and both said first and second switched lines, when said second PSD is in said second position; and c) a third PSD comprising a line side and a load side and at least a first and a second pole, said line sides of said first and second poles of said third PSD being electrically connected to said first and second switched lines respectively, and said load side of one of said first and said second poles of said third PSD being electrically connected to a third switched line, said third PSD adapted to selectively interrupt current to said third switched line.

10. The switching arrangement as recited in claim 9, further comprising a fourth switched line being electrically connected to said load side of another of said first and said second poles of said third PSD, said third PSD adapted to selectively interrupt current to said fourth switched line.

11. The switching arrangement as recited in claim 9, wherein at least said first PSD comprises at least one chosen from the group: an electrical switch; two electrical switches, each comprising at least one pole, two positions and three connection points, said two electrical switches being electrically connected in a "three way switch"configuration; an occupancy sensor; and a timer switch.

12. A system for controlling the light output generated by a plurality of electrically powered light producing devices (EPLPDs) comprising:

a) a plurality of EPLPDs;

b) a first power switching device (PSD) movable between an open and a closed position operatively connectable to a power source and being electrically connected to said plurality of EPLPDs when said first PSD is in said closed position;

c) a second PSD having at least a first and a second position, said second PSD movable between said first and second positions, said second PSD being electrically connected to said first PSD and to said plurality of EPLPDs to allow a different overall illumination output from said plurality of EPLPDs at said first and second positions of said second PSD; and d) a third PSD movable between an open and a closed position and comprising at least two poles, said third PSD being electrically connected to said second PSD and to a subset of said plurality of EPLPDs to selectively prevent illumination of said subset of said plurality of EPLPDs when said third PSD is in said open position.

13. The switching arrangement as recited in claim 12, wherein at least said first PSD comprises at least one chosen from the group: an electrical switch; two electrical switches, each comprising at least one pole, two positions and three connection points, said two electrical switches being electrically connected in a "three way switch" configuration; an occupancy sensor; and a timer switch.

14. The system as recited in claim 12, wherein said plurality of EPLPDs comprises at least a first and second zone of said plurality of EPLPDs, and one of said first or second zone of EPLPDs is prevented illumination when said third PSD is in said open position.

15. The system as recited in claim 12, further comprising a luminaire comprising at least one of said plurality of EPLPDs.

16. The system as recited in claim 12, further comprising a modular wiring system.

17. A lighting control system to control the flow of electrical current to a plurality of dimmable power supplies (DPSs) and light output from associated light producing devices (LPDs) comprising:

a) a plurality of DPSs each comprising a dimming interface;

b) a first power switching device (PSD) comprising at least one pole and a first and a second connection point, said first connection point operatively connectable to a power source;

c) a dimming device being electrically connected to said dimming interface on said plurality of DPSs to allow said associated LPDs to generate at least two different light outputs;

d) a second PSD comprising at least one pole and a first and a second connection point, said first connection point being electrically connected to said second connection point on said first PSD and to a first switched line operatively connectable to a first group consisting of at least one DPS selected from said plurality of DPSs to generate a first light output, said second connection point of said second PSD being electrically connected to a second switched line operatively connected to a second group consisting of at least one other DPS selected from said plurality of said DPSs to generate a second light output different from said first light output.

18. The lighting control system as recited in claim 17, wherein at least said first PSD comprises at least one chosen from the group: an electrical switch; two electrical switches, each comprising at least one pole, two positions and three connection points, said two electrical switches being electrically connected in a "three way switch"configuration; an occupancy sensor; and a timer switch.

19. The lighting control system as recited in claim 17, further comprising a luminaire comprising at least one of said LPDs.

20. The lighting control system as recited in claim 17, wherein said dimming device is chosen from the group: a dimmer circuit, at least one variable resistor, and at least one resistor in combination with an electric switch.

* * * * *